US005988181A

United States Patent [19]

Gable et al.

[11] Patent Number: 5,988,181

[45] Date of Patent: Nov. 23, 1999

[54] FILAMENT BRAIDING APPARATUS

[75] Inventors: Derek Gable, Rancho Palos Verdes; Morris Betty, Redondo Beach, both of Calif.

[73] Assignee: Solutions Toy Innovations, Inc., Torrance, Calif.

[21] Appl. No.: 09/220,181

[22] Filed: Dec. 23, 1998

[51] Int. Cl.[6] ..... A45D 7/00

[52] U.S. Cl. ..... 132/210; 132/212; 132/200; 87/33

[58] Field of Search ..... 132/210, 212, 132/271, 223, 200, 273, 330, 332; 87/33, 8, 13, 62; 57/4, 28, 29, 30; 242/442

[56] References Cited

U.S. PATENT DOCUMENTS

| | | | |
|---|---|---|---|
| 3,295,535 | 1/1967 | Amato | 132/210 |
| 3,808,736 | 5/1974 | Terzian et al. . | |
| 4,038,996 | 8/1977 | Eronini et al. . | |
| 4,307,737 | 12/1981 | Shipman | 132/223 |
| 4,369,690 | 1/1983 | Sapkus | 87/33 |
| 4,427,017 | 1/1984 | Eronini . | |
| 4,580,585 | 4/1986 | Sapkus | 132/271 |
| 4,583,561 | 4/1986 | Larsson | 132/212 |
| 4,824,036 | 4/1989 | Buta | 242/442 |
| 5,180,324 | 1/1993 | Simmons . | |
| 5,456,271 | 10/1995 | Legette | 132/212 |
| 5,456,272 | 10/1995 | Johnson . | |
| 5,488,963 | 2/1996 | Fishman | 132/212 |
| 5,518,011 | 5/1996 | Nash . | |
| 5,575,297 | 11/1996 | Hatchett et al. . | |
| 5,590,668 | 1/1997 | Macy . | |

*Primary Examiner*—Gene Mancene
*Assistant Examiner*—Philogene Pedro
*Attorney, Agent, or Firm*—Lerner, David, Littenberg, Krumholz & Mentlik, LLP

[57] ABSTRACT

A hand held braiding apparatus is operative for braiding elongated filaments in the nature of natural hair and filaments of synthetic material. The apparatus includes a rotatable actuator having an opening operative for receiving a plurality of filament holders in the form of elongated cylindrical tubes. By repetitive operation of the actuator, the filament holders are manipulated into a sequence of positions which effect braiding of filaments received therein.

46 Claims, 7 Drawing Sheets

FILAMENT BRAIDING APPARATUS

FIELD OF THE INVENTION

The present invention relates in general to a filament braiding apparatus, and more particularly, to a braiding apparatus suitable for use with human hair, synthetic filaments such as commonly used to simulate human hair on toy dolls, as well as other elongated filaments of natural or synthetic materials which are desirable of being formed in a braid.

BACKGROUND OF THE INVENTION

Machines for the manipulation of elongated filaments have been known for many years having a variety of applications. For example, known machines were used in creating yarn by simply twisting multiple strands together. Other such machines for use in forming rope and cord generally employed mechanisms for interweaving two strands. Other such machines for use in the textile industry typically included complicated assemblies which were part of an overall machine with complex mechanisms.

The uniqueness of a braid has created the need for the development of a variety of devices suitable for manipulating natural and synthetic hair, such as human hair and artificial doll hair, into one or more desirable forms. For example, Eronini, et al., U.S. Pat. No. 4,038,996 discloses a portable hair braider using a plurality of sets of hair parters that are arranged in a row which extend transversely to the path of movement of the device over the top of a person's head. The hair parters divide the hair over a predetermined width of the scalp, and then feed these separate hair portions into hair grippers which clamp and rotate the strands for weaving them together to form a braid. In this manner, the hair covering a predetermined width of the scalp is divided into plural groups of hair strands and formed into a single braided strand. See also Eronini, U.S. Pat. No. 4,427,017.

The aforementioned hair braiding devices are relatively complicated and cumbersome for use. To this end, there is known a portable hair braiding apparatus from Shipman, U.S. Pat. No. 4,307,737 and Sapkus, U.S. Pat. No. 4,369, 690. Shipman discloses a hand operated machine with tubular holders for three sections of hair. The three tubular holders are each designed to maintain the separation of the sections of hair, while moving within a system of tracks and guide rails to weave the individual sections of hair into a basic braid. Sapkus discloses another hand operated machine with tubular holders for three sections of hair. In this machine, the three tubular holders are rotated in a manner that results in the formation of a basic braid, the rotation being effected by means of a mechanism including a lever and a plurality of gear members.

In addition to the aforementioned machine-type hair braiding devices, hair braiding devices which require manual manipulation to effect the braiding operation are known. For example, Hatchett, et al., U.S. Pat. No. 5,575, 297 discloses the combination of a skeletal frame assembly having plural spaced apart skeletal support members for receiving a member having a corresponding plurality of resilient elongated members. Macy, U.S. Pat. No. 5,590,668 discloses a plurality of individual hair retainers for holding separate groups of hair. Nash, U.S. Pat. No. 5,518,011 discloses a comb having a plurality of spaced fingers supported by a handle to enable braiding of hair within a series of slots formed therein. Johnson, U.S. Pat. No. 5,456,272 discloses a hair braiding device having a plurality of movable arms for gripping and enabling manual manipulation of the hair for forming a braid.

There is also known a number of devices which are suitable for twining hair. For example, such devices are known from Fishman, U.S. Pat. No. 5,488,963, Sapkus, U.S. Pat. No. 4,580,585,Larsson, U.S. Pat. No. 4,583,561 and Buta, U.S. Pat. No. 4,824,036.

Additional hair styling devices are known from Legette, U.S. Pat. No. 5,456,271 which is a tool for applying beads to gathered strands of braided or unbraided hair. Terzian, et al., U.S. Pat. No. 3,808,736 discloses a hair styling figure having an accessory to enable styling of the hair for curling, braiding or other styling arrangements.

Accordingly, there is still the room for improvements in a portable braiding apparatus suitable for use in braiding natural and synthetic filaments, such as human hair or artificial toy doll hair, as well as other natural and synthetic filaments in forming hair braids, rope, cord and the like.

SUMMARY OF THE INVENTION

The filament braiding apparatus of the present invention includes a housing which rotatably supports an actuator having a configured opening therein. A plurality of elongated hollow filament holders are received within the opening for manipulation upon rotation of the actuator in a sequence which braids elongated filaments within the holders.

The opening is formed from a primary opening and a pair of spaced apart secondary openings which generally form a Y-shape. At all times during operation of the apparatus, two filament holders are maintained in the primary opening, one filament holder residing in one of the secondary openings. By repetitive back and forth rotation of the actuator, the filament holder in one of the secondary openings is manipulated so as to be inserted between the two filament holders residing in the primary opening. As a result, one of the two filament holders in the primary opening is displaced into the other secondary opening. Further manipulation of the actuator causes the displaced filament holder to be positioned between the two filament holders in the primary opening, once again causing one of the filament holders to be displaced into the other secondary opening. The sequence of manipulation of the filament holders may be defined by the sequence of positions 1-2-3, 1-3-2, 3-1-2, 3-2-1, 2-3-1 and 2-1-3.

The filament holders are guided within the opening by a lip of the actuator which defines the opening, the lip being received within a circumscribing groove within each filament holder. A spring bias member is operative for urging one of the filament holders between the remaining filament holders within the primary opening during rotation of the actuator. The filament holders are provided with a further groove which is operative for receiving the spring bias member to further maintain proper positioning of the filament holders during operation of the actuator. The position of the filament holders within the secondary openings are facilitated by a laterally biased spacer which is restricted in movement between the spaced apart secondary openings by a depending wall portion of the actuator adjacent the secondary openings.

In accordance with one embodiment of the present invention there is described an apparatus for braiding elongated filaments, the apparatus comprising a housing, an actuator within the housing movable between a first and second position, the actuator including an opening having a primary opening in communication with a pair of spaced apart secondary openings, a plurality of filament holders individually movable within the opening between the primary opening and the pair of secondary openings, at least two of the filament holders being arranged within the primary opening and at least one of the filament holders being arranged within one of the secondary openings when the actuator is in the first position, whereby the filament holder within the one of secondary openings is manipulated into a position between the filament holders within the primary opening while one of the filament holders within the primary opening is manipulated into a position within the other of the secondary openings upon movement of the actuator from the first position to the second position.

In accordance with another embodiment of the present invention there is described an apparatus for braiding elongated filaments, the apparatus comprising a housing, an actuator within the housing having an opening therein, the opening rotatable between a first and second position within the housing upon rotation of the actuator therein, three filament holders individually movable within the opening into one of three positions to form a contiguous row thereof upon rotation of the opening between the first and second positions by operation of the actuator, the positions of the filament holders relative to one another defined by the sequence of positions 1-2-3, 1-3-2, 3-1-2, 3-2-1, 2-3-1 and 2-1-3.

In accordance with another embodiment of the present invention there is described an apparatus for braiding elongated filaments comprising a housing, an actuator movable within the housing between a first and second position, the actuator including an opening having a primary opening and a pair of spaced apart secondary openings in communication with the primary opening, the opening having a Y-shape, a plurality of filament holders individually movable between the primary opening and the secondary openings upon rotation of the actuator.

In accordance with another embodiment of the present invention there is described a method of braiding elongated filaments, the method comprising the steps of providing a Y-shaped opening having a primary opening and a pair of spaced apart secondary openings in communication with the primary opening, positioning a plurality of filament holders within the opening, and moving the position of the filament holders between the primary opening and the secondary openings to braid filaments extending within the filament holders.

In accordance with another embodiment of the present invention there is described a method of braiding elongated filaments, the method comprising the steps of providing an actuator including an opening having a primary opening and a pair of spaced apart secondary openings, positioning a plurality of filament holders within the opening, inserting at least one filament within each of the filament holders, moving the actuator repetitively between a first and second position for manipulation of the filament holders within the opening between the primary opening and the secondary openings, whereby the filament holder within the one of secondary openings is manipulated into a position between the filament holders within the primary opening while one of the filament holders within the primary opening is manipulated into a position within the other of the secondary openings.

In accordance with another embodiment of the present invention there is described an implement for releasably securing at least one filament thereto, the implement comprising a handle and a body at one end of the handle, the body including a first opening for receiving at least one filament therein and a second opening enabling the insertion and removal of the filament into and out of the first opening, the body being constructed whereby the second opening is expandable to enable the passage of the filament therethrough into the first opening for releasably securing the filament to the body.

BRIEF DESCRIPTION OF THE DRAWINGS

The above description, as well as further objects, features and advantages of the present invention will be more fully understood with reference to the following detailed description of a filament braiding apparatus, when taken in conjunction with the accompanying drawings, wherein.

DETAILED DESCRIPTION OF THE PREFERRED EMBODIMENTS

Figure 1:
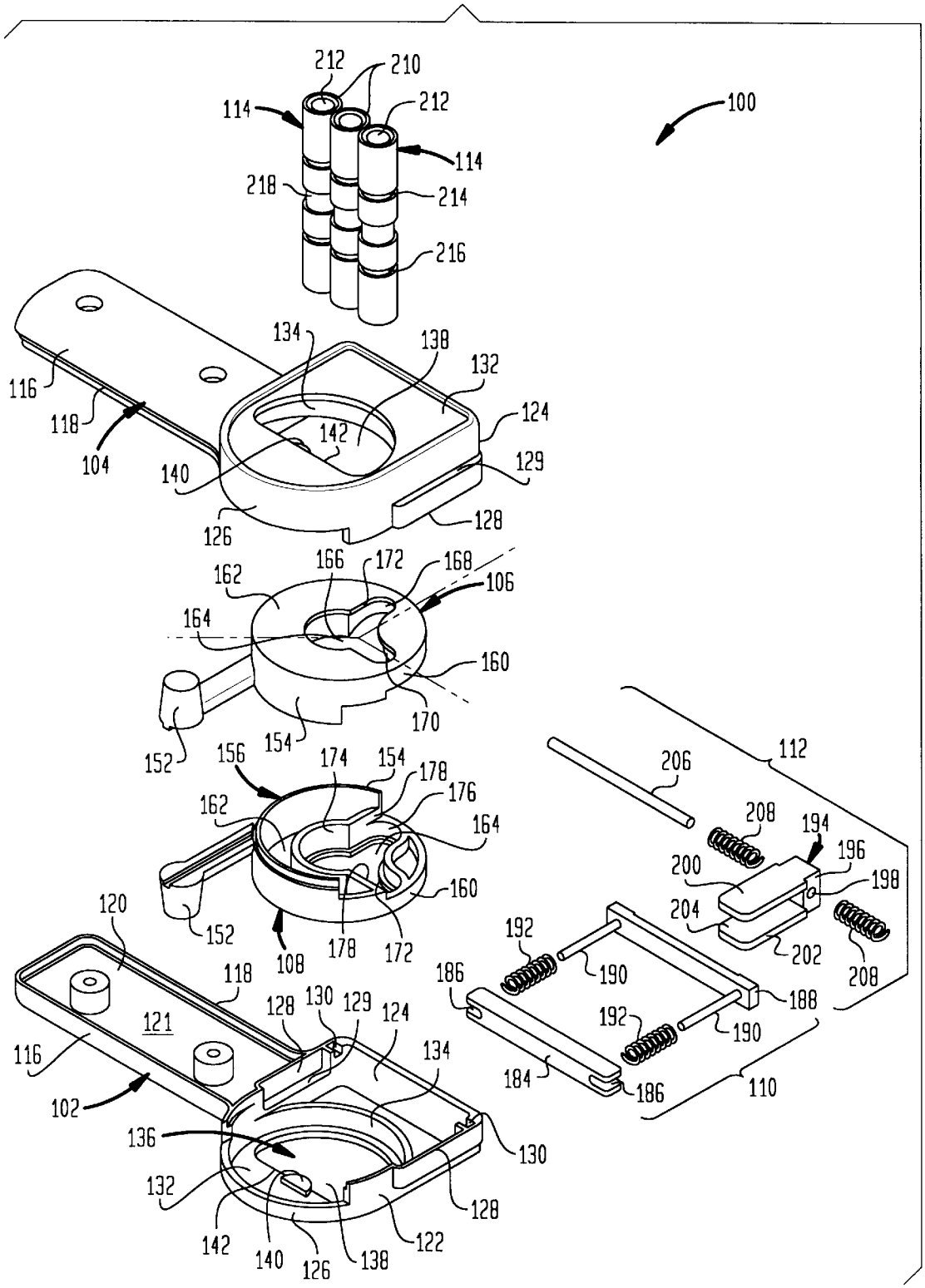
FIG. 1 is a perspective exploded view of the individual components of the filament braiding apparatus in accordance with one embodiment of the present invention as shown in unassembled relationship.

Turning now to the drawings, wherein like reference numerals represent like elements, there is shown in FIG. 1 the components of an unassembled filament braiding apparatus generally designated by reference numeral 100. The braiding apparatus 100 includes a lower housing half 102, an upper housing half 104, an upper actuator half 106, a lower actuator half 108, a filament holder biasing assembly 110, a filament holder spacer assembly 112 and a plurality of filament holders 114. The components as thus far described, except for portions of the biasing and spacer assemblies 110, 112, can be formed from suitable plastic materials by injection molding or the like.

The lower housing half 102 includes an elongated handle section 116 formed by a surrounding upstanding wall 118 defining a recessed cavity 120 opposing bottom wall 121. An actuator section 122 is formed as an extension of the handle section 116, likewise formed by a surrounding upstanding wall 124. Wall 124 is generally of uniform height except for a wall section 126 having a reduced height extending along one side of the actuator section 122. The wall 124 is internally formed with a pair of opposing spaced apart elongated recessed portions 128 having a flat bottom 129. Adjacent one end of the recessed portions 128, the wall 124 is provided with a pair of spaced apart notches 130. As shown, the depth of the recessed portions 128 is greater than the depth of the notches 130.

The actuator section 122 is provided with a bottom wall 132 which is surrounded by the upstanding wall 124. A curved internal wall 134 extends upwardly from the bottom wall 132 merging at its opposite ends with the interior portion of wall 124. As shown, wall section 126 is also of curved shape so as to form, with internal wall 134, a generally circular opening 136. The height of internal wall 134 is less than that of upstanding wall 124, for example, less than about half the height of wall 124 above the bottom wall 132. A D-shaped opening 138 is formed within the bottom wall 132 within the circular opening 136 defined by internal wall 134 and wall section 126. A boss 140 is attached to the bottom wall 132 so as to have a portion extending into the D-shaped opening 138 along straight side 142. It will be understood from a further description of the invention that opening 138 can be other than D-shaped, for example, oval, square, circular and the like.

Figure 2:
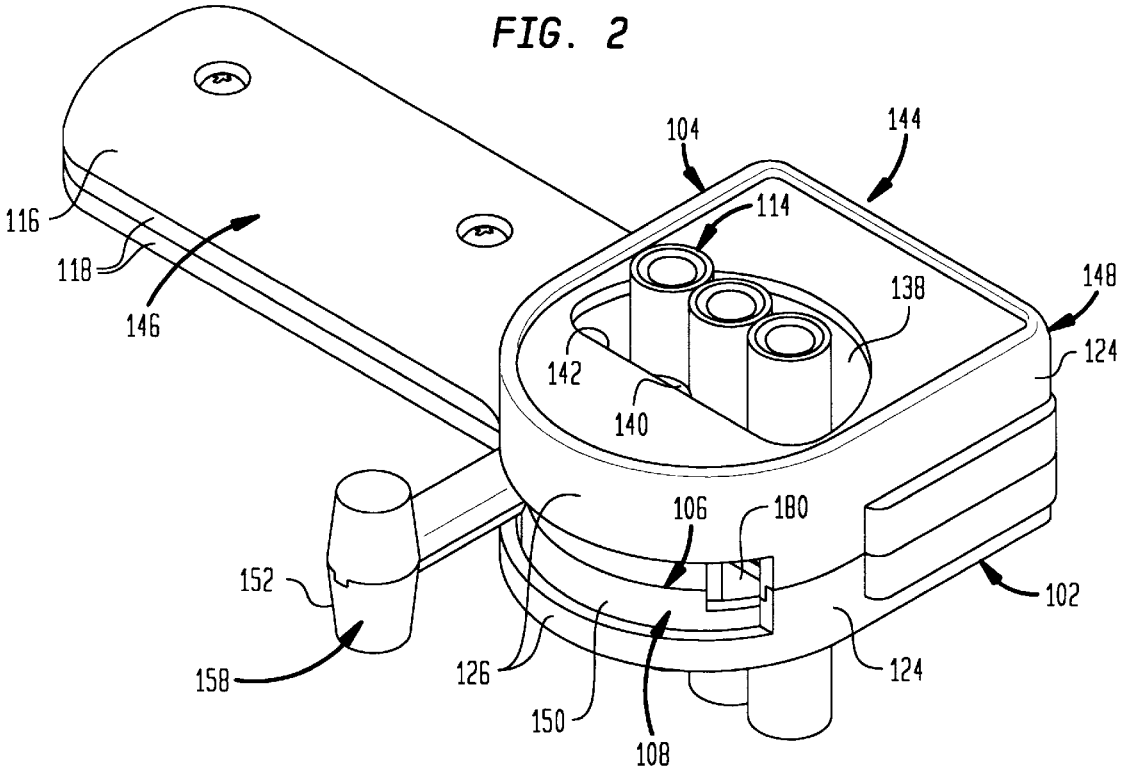
FIG. 2 is a perspective view of a fully assembled filament braiding apparatus.

The upper housing half 104 is generally similarly constructed, for example, being a mirror image of the lower housing half 102. As a result, the lower and upper housing halves 102, 104 may be mated together along the peripheral edges of upstanding wall 118 defining the handle section 116 and upstanding wall 124 defining the actuator section 122, see FIG. 2. As shown in FIG. 2, the assembled lower and upper housing halves 102, 104 provide a housing generally designated by reference numeral 144 having a handle 146 and an actuator housing 148. The actuator housing 148 is provided with an elongated slot 150 formed between the opposing wall sections 126 which oppose one another upon joining together of the lower and upper housing halves 102, 104. The slot 150 is the result of the wall sections 126 being less than the height of the upstanding wall 124 from which they are formed with respect to the lower and upper housing halves 102, 104. In a like manner, the recessed portions 128 and notches 130 in the respective lower and upper housing halves 102, 104 oppose one another upon assembly of the housing halves in forming the actuator housing 148. The joining of the lower and upper housing halves 102, 104 also forms an internal cylindrical space, see FIG. 4, defined by the curved internal walls 134 and wall sections 126 for receiving the assembled upper and lower actuator halves 106, 108 as to be described.

Figure 4:
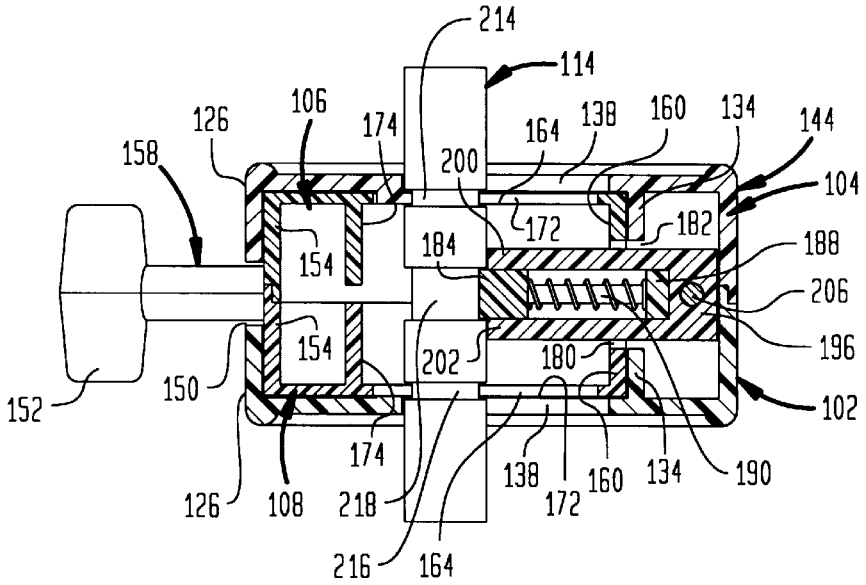
FIG. 4 is a cross-sectional view of the assembled filament braiding apparatus.

The upper and lower actuator halves 106, 108 are of generally like construction so when in assembled relationship, they form an actuator 158, as generally shown in cross-section in FIG. 4. By way of illustration, the lower actuator half 108 includes a handle 152 which extends outwardly from an upstanding wall 154 which defines a cylindrical actuator body section 156. The wall 154 includes a wall section 160 of reduced height compared to the remaining portion of the upstanding wall. The upstanding wall 154 surrounds a bottom wall 162 having an opening 164 therein. The opening is formed from a primary opening 166 and a pair of spaced apart secondary openings 168, 170. The primary opening 166 is generally in the nature of a portion of a circle, while the secondary openings 168, 170 are more in the nature of an elongated slot. The primary opening 166 and secondary openings 168 communicate with each other in forming a single opening 164 having a generally Y-shape formed by their respective axes as shown in FIG. 1.

The opening 162 is circumscribed by an inwardly extending lip 172 formed from a portion of the bottom wall 162. A curved first internal wall 174 extends upwardly from the bottom wall 162 surrounding the primary opening 166 from which lip 172 projects. In a similar manner, a curved second internal wall 176 extends upwardly from bottom wall 162 surrounding the secondary openings 168, 170. As shown, the height of the second internal wall 176 is less than the height of the first internal wall 174. In addition, the height of the first internal wall 174 is less than the height of the upstanding wall 154. The height differential between the first and second internal walls 174, 176 provides a pair of spaced apart abutments 178 on either side of the secondary openings 168, 170 adjacent the primary opening 166.

The upper and lower actuator halves 106, 108 are assembled opposing one another so as to provide the actuator 158 as shown partially in FIG. 2 and in cross-section in FIG. 4. In this regard, like elements of the upper actuator half 106 are mated and/or oppose similar elements in the lower actuator half 108. The resulting actuator 158 is generally a cylindrical hollow body having a slot 180 along a sidewall portion of the actuator. The slot 180 is formed from opposing portions of the wall section 160 of reduced height. As shown in FIG. 1, the slot 180 extends around a substantial portion of the actuator 156. As will be described hereinafter, the slot 180 is operative for accommodating the filament holder bias assembly 110 and filament holder spacer assembly 112. As shown in FIG. 4, slot 180 opposes a slot 182 formed between the opposing curved internal walls 134 which are provided within the lower and upper housing halves 102, 104.

Figure 3:
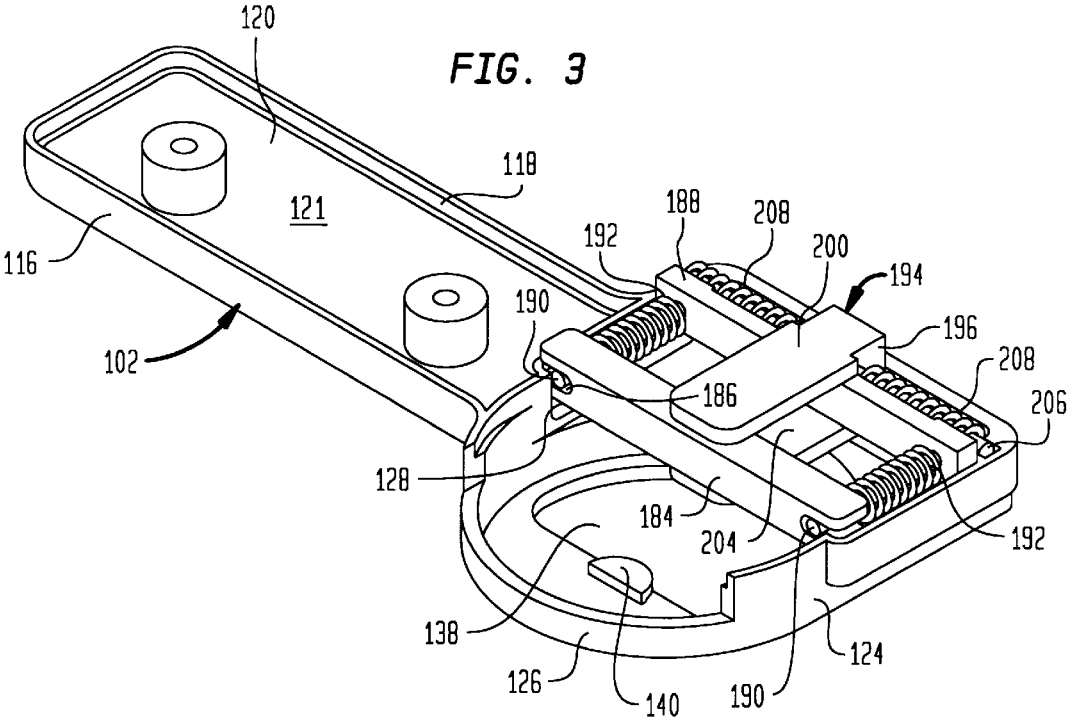
FIG. 3 is a perspective view of a portion of the filament braiding apparatus being partially assembled.

The filament holder bias assembly 110, as shown in FIG. 1, includes an elongated bar member 184 having slotted openings 186 at either end thereof. An elongated base member 188 is provided with a pair of outwardly extending spaced apart elongated posts 190. Received about each of the posts 190 is a compression spring 192. As shown in FIG. 3, the filament holder bias assembly 110 is assembled for positioning between the recessed portions 128 formed within the actuator sections 122 of the lower and upper housing halves 102, 104. The base member 188 is arranged supported on the bottom 129 of the recessed portions 128 adjacent notches 130 with the posts 190 extending alongside of the recessed portions. A compression spring 192 is arranged in sliding fit over each of the posts 190. The bar member 184 is positioned having its ends supported by the bottom 129 of the recessed portions 128. The free end of the posts 190 extend through the slotted openings 186 at either end of the bar member 184. In the assembled relationship, the posts 190 are freely slidable through the slotted openings 186, which may be of other shapes such as circular openings and the like. The compression springs 190 are of sufficient length so as to urge the bar member 184 against a portion of the upstanding wall 124 which connects to the recessed portions 128 to provide a stop. This construction allows the bar member 184 to reciprocally slide along the extent of the recessed portions 128 under spring compression via compression spring 192.

The filament holder spacer assembly 112 includes a spacer 194 formed from a base 196 having an opening 198 extending therethrough. A pair of generally flat arms 200, 202 extend outwardly from the base 196 in spaced apart overlying relationship so as to provide a generally U-shape with an opening 204 formed between the arms. The filament holder spacer assembly 112 further includes an elongated rod 206 and a pair of compression springs 208.

As shown in FIGS. 3 and 4, the spacer 194 via opening 198 is slid onto rod 206 with a compression spring 208 on either side thereof. The ends of the rod 206 are received within the spaced apart notches 130 formed within the upstanding wall 124 of the lower and upper housing halves 102, 104. The bar member 184 and base member 188 of the filament holder bias assembly 110 are received within the opening 204 formed between the arms 200, 202 of the spacer 194. This arrangement allows the spacer 194 to slide laterally along the rod 206, as well as along the bar member 184 and base member 188 under compression as a result of compression springs 208.

The filament holders 114 are in the nature of an elongated cylindrical member 210 having a longitudinal opening 212 extending therethrough. A pair of spaced apart narrow grooves 214, 216 circumscribe the cylindrical member 210 adjacent either end thereof. A third groove 218, typically wider than grooves 214, 216, is disposed therebetween circumscribing the cylindrical member 210. In order to effect a braiding operation, it is contemplated that three filament holders 114 are required. In this regard, the use of two filament holders will result in the twisting of elongated filaments, as opposed to braiding. However, more than three filament holders 114 may be used as will become apparent from a description of the operation of the filament braiding apparatus 100 in accordance with the present invention.

As shown in FIG. 4, the actuator 158 is assembled within the housing 144 so as to be received within the circular opening 136. The bar member 184 of the filament holder biasing assembly 110 and the spacer 194 of the filament holder spacer assembly 112 are received within the slot 180 formed between the opposing wall sections 160 of the actuator 158. As more clearly shown in FIG. 2, the handle 152 of the actuator 158 extend outwardly through the slot 150 formed within the housing 144 between the opposing wall sections 126 of the housing. This assembled construction of the filament braiding apparatus 100 enables rotation of the actuator 158 within the housing 144 by movement of the handle 152 along the longitudinal extent of the slot 150. In assembled relationship, the opening 164 of the actuator 158 is arranged underlying the opening 138 in the housing 144.

Three filament holders 114 are inserted into the filament braiding apparatus 100 extending through the aligned openings 138, 164 within the respective housing 144 and actuator 158. Initially, two filament holders 114 are positioned within the primary opening 166 of opening 164, and one filament holder in one of the secondary openings 168, 170. This arranges the filament holders 114 in a straight row as shown in FIG. 2. As further shown in FIG. 4, the lip 172 formed by the upper and lower actuator halves 106, 108 and boss 140 are received within the upper and lower grooves 214, 216 on the filament holders. In a similar manner, the bar member 184 is received within groove 218 under the compressive force of springs 192. The free ends of the upper and lower arms 200, 202 of the spacer 194 lie opposing the outer surface of the central filament holder 114 on either side of the groove 218. The individual components of the hair braiding apparatus 100 and their assembly has heretofore been described.

Figure 6A:
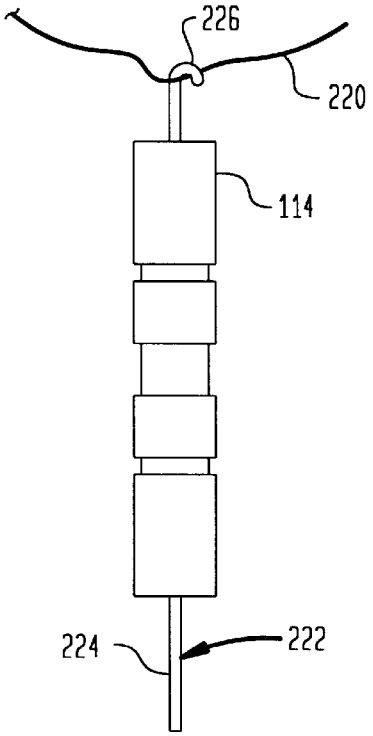
FIGS. 6A and 6B are front elevational views showing the insertion of an elongated filament into one of the filament holders.
Figure 6B:
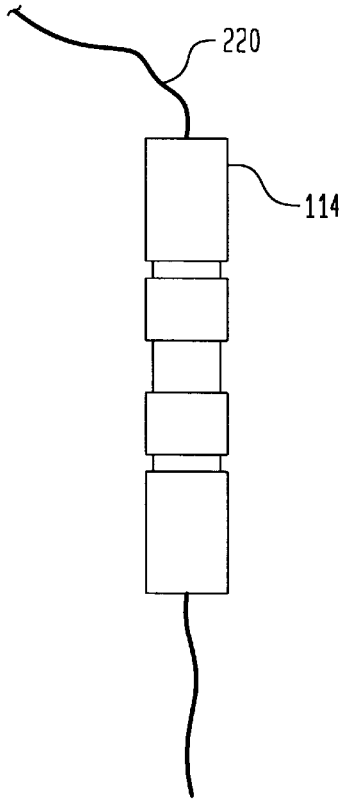

Turning now to FIGS. 5A–5F and 6A and 6B, there will be described the operation of the filament braiding apparatus 100 so as to braid a plurality of elongated filaments. As shown in FIGS. 6A and 6B, an elongated filament 220 is pulled through a filament holder 114 using an implement 222. The implement 222 is provided with an elongated handle 224 terminating at one end by a hook 226. The hook end of implement 222 is slid through the opening 212 in a respective filament holder 114 so as to extend therebeyond. One or a plurality of filaments 220 are captured by the hook 226 and pulled through the filament holder 114 by handle 224. The resulting filaments 220 extend longitudinally through each of the filament holders 114 as shown in FIG. 6B. Thus, each of the filament holders 114 may receive a single filament 220 or a plurality of filaments 220 which may be pulled therethrough by means of the implement 222, either one at a time or in a plurality of filaments depending upon the size of the hook 226 and the diameter of the filaments 220.

Figure 5B:
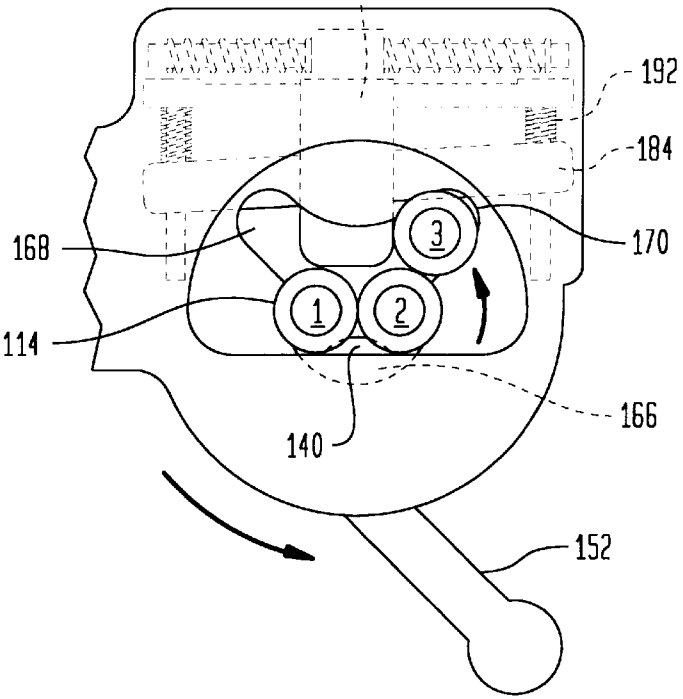
FIGS. 5A–5F are a sequential series of top plan views showing the operation of the filament braiding apparatus and braiding elongated filaments in accordance with one embodiment of the present invention.
Figure 5A:
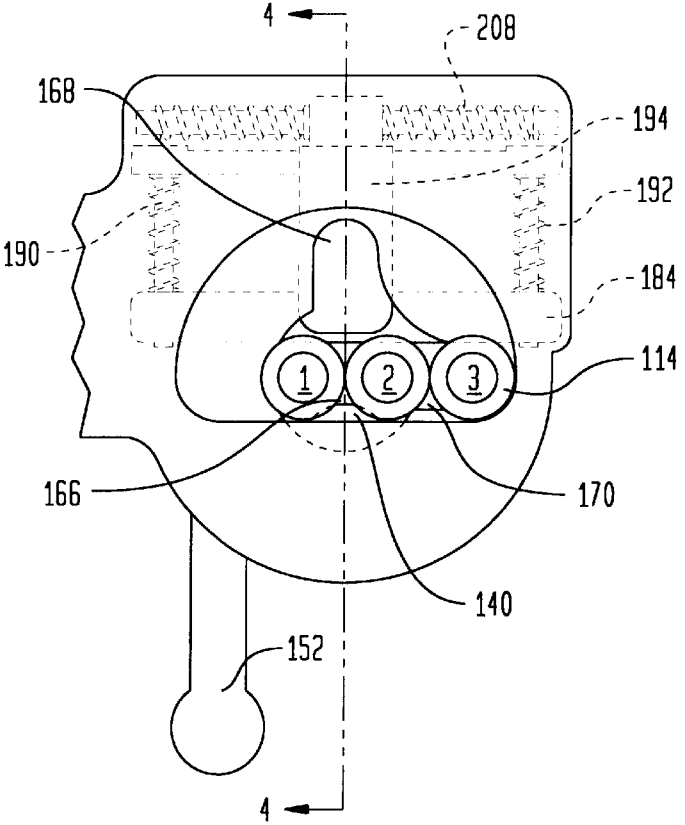
Figure 5D:
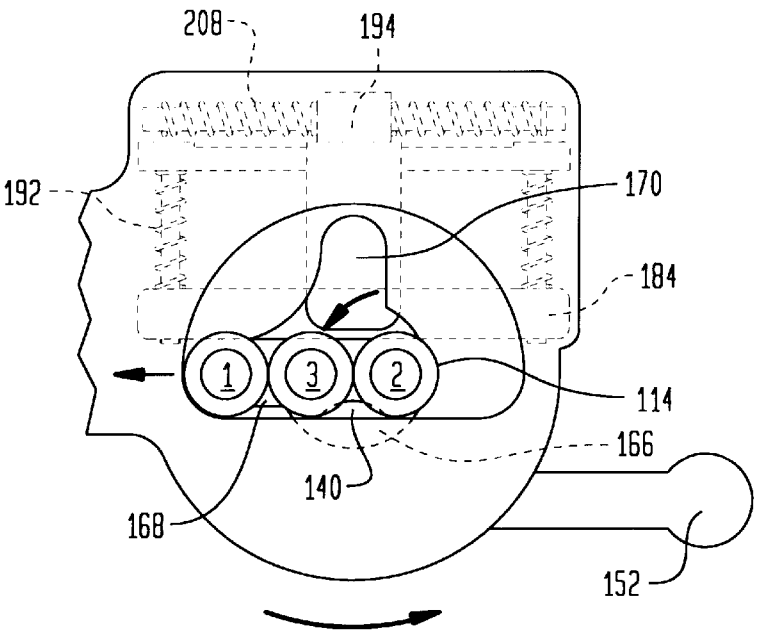
Figure 5C:
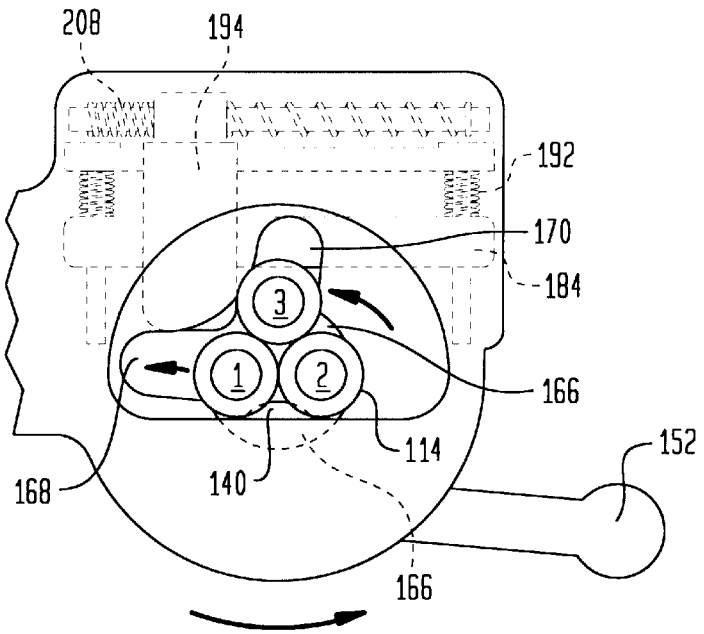

As shown in FIG. 5A, the filament holders 114 are arranged in a straight row, two filament holders #1 and #2 being retained within the primary opening 166, the right most filament holder #3 being received within the secondary opening 170. The filament holders 114 are maintained in a straight row by compressive action of the bar member 184 being urged within groove 218 by compression springs 192. The spacer 194 is positioned midway between filament holder #1 and filament holder #2, underlying secondary opening 168 of the opening 164. By rotation of the actuator 158 counterclockwise by means of handle 152, filament holder #3 is also rotated counterclockwise as shown in FIG. 5B. During this rotation, filament holder #3 displaces one end of bar member 184 against the compressive force of springs 192. As the bar member 184 is provided with slotted openings 186, the bar member is allowed to skew as it is being displaced by filament holder #3. When the actuator 158 reaches the position as shown in FIG. 5C, the secondary opening 168 has been rotated into position opposing boss 140, whereby filament holder #3 is positioned midway between filament holders #1 and #2. The spacer bar 194 has been laterally displaced to the left against the compressive force of spring 208 as a result of being engaged by filament holder #3.

When the aforementioned position has been achieved, filament holder #3 is urged between filament holders #1 and #2 by bar member 184 by operation of compression springs 192. This causes filament holder #1 to be displaced laterally into secondary opening 168 as shown in FIG. 5D. At this time, the spacer 194, no longer being constrained by filament holder #3, is urged back to its central position underlying secondary opening 170 by means of the left most compression spring 208. The spacer 194 is stopped from further displacement by contact with abutment 178. The spacer 194 facilitates controlling the movement of filament holder #3 so as to be urged between filament holders #1 and #2, as filament holder #1 is displaced into the secondary opening 168.

Figure 5F:
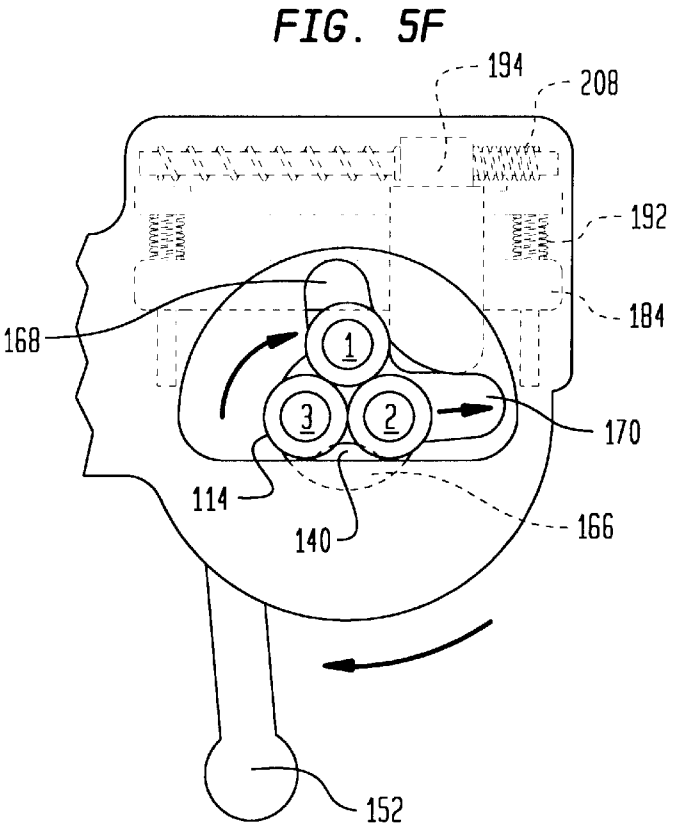
Figure 5E:
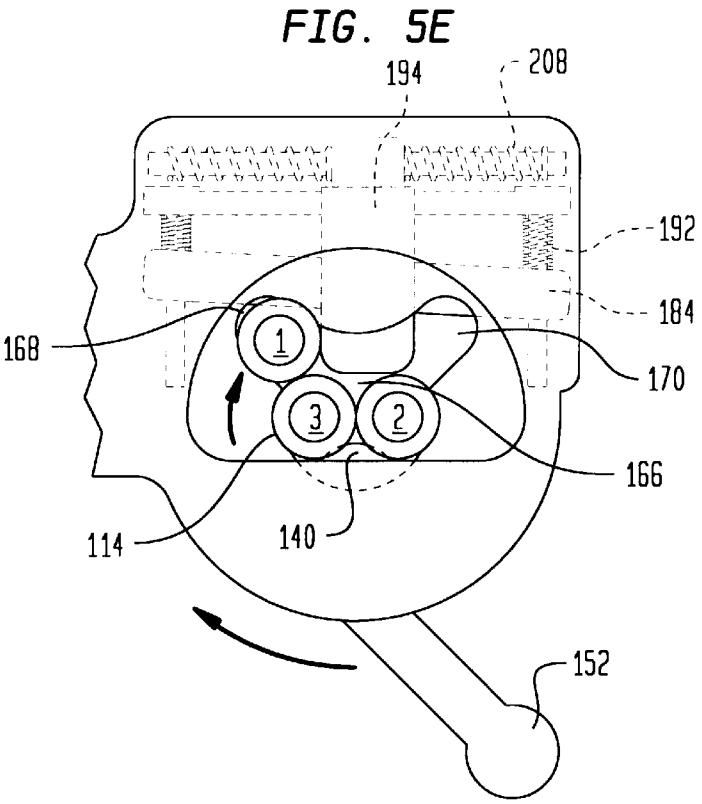

The aforementioned sequence is repeated in the reverse by rotating the actuator 158 in a clockwise direction as shown in FIGS. 5E and 5F. Upon clockwise rotation of the actuator 158 by handle 152, filament holder #1 which is received within the secondary opening 168 is rotated clockwise into position between filament holders #2 and #3 as shown in FIG. 5F. In this position, the bar member 184 by action of the compression springs 192 forces filament holder #1 into a straight row between filament holders #2 and #3 as filament holder #2 is displaced laterally to the right so as to be received within secondary opening 170. The filament holders 114 are now arranged in the positional sequence 3-1-2.

By rotating handle 152 of the actuator 158 back and forth in clockwise and counterclockwise directions, the filament holders 114 are interchanged within opening 164 via the primary opening 166 and secondary openings 168, 170 so as to braid the elongated filaments which extend through the filament holders. During manipulation of the filament holders 114 within the opening 164, the filament holders are maintained in substantially contiguous relationship with each other. The particular sequence as thus far described will be the positions designated as 1-2-3, 1-3-2, 3-1-2, 3-2-1, 2-3-1 and 2-1-3. This sequence is repeated as often as required so as to effect the length of the braid for the elongated filaments.

Figure 7:
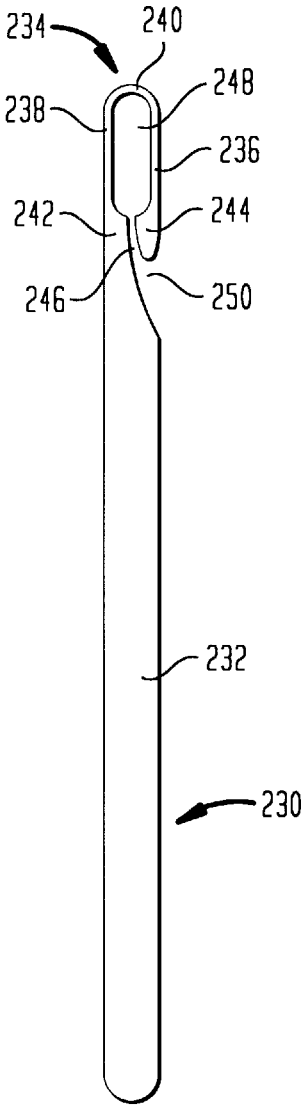
FIG. 7 is a front elevational view of an implement for pulling a plurality of filaments to be braided through the braiding apparatus in accordance with one embodiment of the present invention.

Referring now to FIG. 7, there is illustrated another embodiment of an implement 230 which is operative for pulling at least one elongated filament 220, and generally a plurality of such filaments, through a filament holder 114. The implement 230 is provided with an elongated handle 232 having a body at one end thereof generally designated by reference numeral 234. The body 234 is defined by a generally U-shaped section having a pair of spaced apart legs 236, 238 connected by a central portion 240. As shown, the end 242 of leg 238 is integrally formed with the upper portion of the handle 232. On the other hand, the end 244 of leg 236 is unattached to the handle 232. The ends 242, 244 of the legs 236, 238 are spaced apart so as to provide an opening 246 therebetween, for example, in the nature of an elongated slot or narrow opening. The opening 246 communicates with another, and typically larger opening 248 defined between the legs 236, 238.

Openings 246, 248 are maintained by the central portion 240 of the body 234. In this regard, the body 234 and specifically the central portion 240 is constructed of a resilient, flexible and/or yieldable material, such as plastic or metal. In the case of plastic, the body 234 will be naturally flexible and resilient due to the inherent resiliency of the plastic forming the central portion 240. On the other hand, where a more rigid material is employed such as metal, the dimensions of the central portion 240 are such to provide the requisite flexibility between the spaced apart legs 236, 238 as to be described hereinafter. The construction of the implement 230 further includes a notch 250 in the side of the handle 232 in communication with the opening 246 adjacent the end 244 of leg 236.

The implement 230 is used in generally a similar manner to the implement 222 as previously described with respect to FIGS. 6A and 6B. In the implement 222, the filaments 220 are not releasably attached to the hook 226. As a result, it is necessary to carefully manipulate the implement 222 through the filament holder 114 to ensure that the filaments do not work themselves loose from the hook 226. This, at times, may be difficult, in particular, where a plurality of filaments 220 are being braided to form a course braid. This process must be repeated for each of the filament holders 114. It would therefore be desirable to provide an implement that could releasably secure the filaments 220 to be braided thereto. In this regard, the implement 230, by virtue of the aforementioned construction, will releasably attach one or more elongated filaments 220 to the body 234.

In the implement 230 as thus far described, the opening 248 is a generally large opening, shown as an elongated opening, so as to releasably secure a plurality of filaments 220 therein. More specifically, a plurality of filaments 220 are gathered together and positioned within the notch 250 and forced through the opening 246. As the plurality of filaments 220 are forced through opening 246, the opening expands by virtue of the central portion 240 being of resilient or yieldable construction so as to allow the legs 236, 238 to separate from one another. As the legs 236, 238 tend to assume their original position once the filaments 220 have passed through the opening 246, the legs provide a compressive force about the filaments with openings 248 so as to hold them releasably attached to the implement 230. Thus, it is contemplated that a sufficient number of filaments 220 will be received within the opening 248 so as to fill up the opening thereby enabling their securement by the force imposed by the legs 236, 238.

In using the filament braiding apparatus 100, three such implements 230 are attached, one at a time, to a plurality of filaments 220 to be braided. At this time, the operator's hands are free of the three attached implements 230 and may pick up the filament braiding apparatus 100. The operator will insert the end of each handle 230 in a respective one of the filament holders 114, pulling same therethrough in a manner as previously described with respect to FIGS. 6A and 6B. Once the implement 230 has been pulled completely through the filament holder 114, the retained filaments 220 can be released therefrom by forcing through opening 246 in a reversed procedure from that thus far described. This process is repeated until the plurality of filaments which have been secured to the respective implements 230 have been inserted in each of the respective filament holders 114 for braiding.

Figure 8:
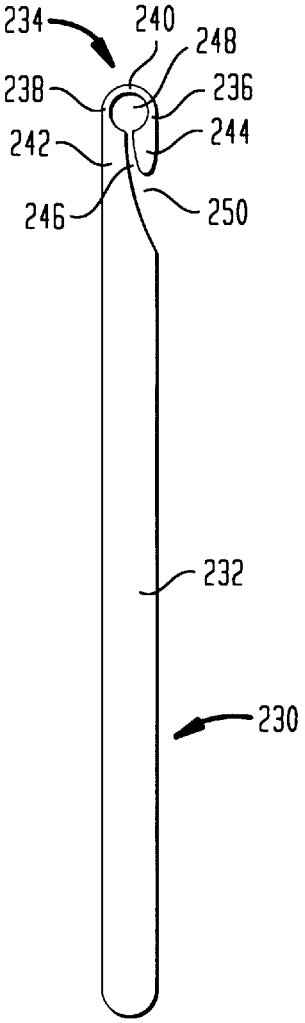
FIG. 8 is a front elevational view of an implement for pulling a plurality of filaments to be braided through the braiding apparatus in accordance with another embodiment of the present invention.

As thus far described, the implement 230 by virtue of an elongated or enlarged opening 248 is designed to accommodate a plurality or large number of filaments 220 to provide what is referred to as a course braid. However, it may be desirable to braid a lesser quantity of filaments 220, and in some instances, individual filaments. To this end, as shown in FIG. 8, the implement 230 is provided with an opening 248 of smaller size so as to accommodate and releasably secure a lesser number of filaments 220. It should be understood that although the openings 248 have been shown as a circle, other shapes such as rectangular, oval, square, triangular and the like may be employed in the implements 230 as shown in FIGS. 7 and 8.

Figure 9:
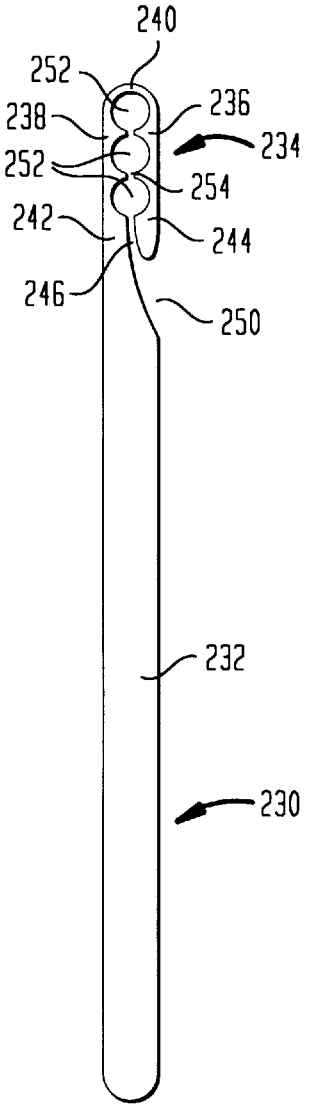
FIG. 9 is a front elevational view of an implement for pulling a plurality of filaments to be braided through the braiding apparatus in accordance with another embodiment of the present invention.

In accordance with still another embodiment of the present invention, as shown in FIG. 9, an implement 230 is operative for securing a varied number of filaments 220 in a single implement construction. In particular, the implement 230 as shown in FIG. 7 is designed for a large number of filaments 220, while the implement shown in FIG. 8 is designed for a lesser number of filaments to effect a finer braid. The implement 230 as shown in FIG. 9 allows for securing both a smaller and greater number of filaments 220 within a single implement to provide both a fine and course braid. To this end, the implement 230 is provided with a body 234 having a plurality of openings 252 each interconnected by a narrow opening 254. Once again, although the openings 252 have been shown as a circle, they may be any shape as previously described. Similarly, the size of the openings 252 can also be varied so as to be the same, or different, depending upon the particular nature of the filaments 220 to be braided. In use, if there are a small number of filaments 220 to be braided, they may be received within the first opening 252 adjacent opening 246. On the other hand, where a greater number of filaments 220 are to be braided, they may be received in the first and second openings 252. Similarly, where even a greater number of filaments 220 are to be braided, they may be received in all three of the openings 252. Thus, it is to be understood that a greater number of openings 252, as well as a lesser number of openings, e.g., two openings, may be provided in the implement 230 as shown in FIG. 9. The use of the implement 230 is as thus far described with respect to the implements of FIGS. 7 and 8.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. An apparatus for braiding elongated filaments, said apparatus comprising a housing, an actuator within said housing movable between a first and second position, said actuator including an opening having a primary opening in communication with a pair of spaced apart secondary openings, a plurality of filament holders individually movable within said opening between said primary opening and said pair of secondary openings, at least two of said filament holders being arranged within said primary opening and at least one of said filament holders being arranged within one of said secondary openings when said actuator is in said first position, whereby said filament holder within said one of secondary openings is manipulated into a position between said filament holders within said primary opening while one of said filament holders within said primary opening is manipulated into a position within the other of said secondary openings upon movement of said actuator from said first position to said second position.

2. The apparatus of claim 1, wherein said filament holders comprise an elongated hollow cylindrical member having at least one groove circumscribing an outer surface thereof.

3. The apparatus of claim 2, wherein said actuator includes a lip defining said opening, said lip being received within said groove during manipulation of said filament holders within said opening.

4. The apparatus of claim 3, wherein said actuator comprises a pair of spaced apart actuator elements each having said opening therein defined by a corresponding lip, said filament holders having a pair of said grooves in spaced apart relationship for each receiving a corresponding one of said lips.

5. The apparatus of claim 1, further including a handle attached to said actuator extending outwardly from said housing for rotating said actuator within said housing between said first and second positions.

6. The apparatus of claim 1, wherein said filament holders comprise three said holders each comprising an elongated hollow cylindrical member for receiving at least one filament therein.

7. The apparatus of claim 1, further including a member movably arranged within said housing opposing said filament holders, said member biased against said filament holders for maintaining said filament holders in a row when said actuator is in said first position and for urging said filament holder from within said one of said secondary openings between the filament holders within said primary opening upon movement of said actuator from said first position to said second position.

8. The apparatus of claim 7, wherein said member comprises an elongated bar biased by a spring assembly.

9. The apparatus of claim 7, wherein said filament holders comprise an elongated hollow cylindrical member having at least one groove circumscribing an outer surface thereof for receiving said member therein.

10. The apparatus of claim 7, wherein said spring assembly comprises a pair of spaced apart posts extending within said housing, a compression spring mounted on each of said posts, said member extending between said posts and having an opening at each end thereof for receiving said posts extending therethrough, whereby said member is movable along said posts so as to compress each of said springs.

11. The apparatus of claim 7, further including a spacer laterally movable along said member, said spacer having a opening extending underlying said pair of secondary openings upon movement of said actuator from said first position to said second position.

12. The apparatus of claim 11, wherein said spacer is laterally biased by a spring assembly, said spring assembly comprising a rod about which said spacer is longitudinally slidable and a compression spring mounted on said rod on either side of said spacer.

13. The apparatus of claim 11, wherein said actuator includes a depending wall adjacent either side of said primary opening for engaging said spacer to confine said spacer to movement between said pair of secondary openings.

14. An apparatus for braiding elongated filaments, said apparatus comprising a housing, an actuator within said housing having an opening therein, said opening rotatable between a first and second position within said housing upon rotation of said actuator therein, three filament holders individually movable within said opening into one of three positions to form a contiguous row thereof upon rotation of said opening between said first and second positions by operation of said actuator, said positions of said filament holders relative to one another defined by the sequence of positions 1-2-3, 1-3-2, 3-1-2, 3-2-1, 2-3-1 and 2-1-3.

15. The apparatus of claim 14, wherein said opening includes a primary opening for receiving two of said filament holders and a pair of spaced apart secondary openings for receiving the third of said filament holders.

16. The apparatus of claim 14 wherein said filament holders comprise an elongated hollow cylindrical member having at least one groove circumscribing an outer surface thereof.

17. The apparatus of claim 16, wherein said actuator includes a lip defining said opening, said lip being received within said groove during manipulation of said filament holders within said opening.

18. The apparatus of claim 17, wherein said actuator comprises a pair of spaced apart actuator elements each having said opening therein defined by a corresponding lip, said filament holders having a pair of said grooves in spaced apart relationship for each receiving a corresponding one of said lips.

19. The apparatus of claim 14, further including a handle attached to said actuator extending outwardly from said housing for rotating said actuator within said housing between said first and second positions.

20. The apparatus of claim 15, further including a member movably arranged within said housing opposing said filament holders, said member biased against said filament holders for maintaining said filament holders in a straight row when said actuator is in said first position and for urging said filament holder from within said one of said secondary openings between the filament holders within said primary opening upon movement of said actuator from said first position to said second position.

21. The apparatus of claim 20, wherein said member comprises an elongated bar biased by a spring assembly.

22. The apparatus of claim 20, wherein said filament holders comprise an elongated hollow cylindrical member having at least one groove circumscribing an outer surface thereof for receiving said member therein.

23. The apparatus of claim 20, wherein said spring assembly comprises a pair of spaced apart posts extending within said housing, a compression spring mounted on each of said posts, said member extending between said posts and having an opening at each end thereof for receiving said posts extending therethrough, whereby said member is movable along said posts so as to compress each of said springs thereabout.

24. The apparatus of claim 20, further including a spacer laterally movable along said member, said spacer having a opening extending underlying said pair of secondary openings upon movement of said actuator from said first position to said second position.

25. The apparatus of claim 24, wherein said spacer is laterally biased by a spring assembly, said spring assembly comprising a rod about which said spacer is longitudinally slidable and a compression spring mounted on said rod on either side of said spacer.

26. The apparatus of claim 20, wherein said actuator includes a depending wall adjacent either side of said primary opening for engaging said spacer to confine said spacer to movement between said pair of secondary openings.

27. The apparatus of claim 14, wherein said opening has the shape of a "Y".

28. An apparatus for braiding elongated filaments comprising a housing, an actuator movable within said housing between a first and second position, said actuator including an opening having a primary opening and a pair of spaced apart secondary openings in communication with said primary opening, said opening having a Y-shape, a plurality of filament holders individually movable between said primary opening and said secondary openings upon rotation of said actuator.

29. A method of braiding elongated filaments, said method comprising the steps of providing a Y-shaped opening having a primary opening and a pair of spaced apart secondary openings in communication with said primary opening, positioning a plurality of filament holders within said opening, and moving the position of said filament holders between said primary opening and said secondary openings to braid filaments extending within said filament holders.

30. The method of claim 29, further including the step of maintaining said filament holders in contiguous relationship during movement of said filament holders within said opening.

31. The method of claim 29, further including the step of retaining said filament holders within said opening by engaging a lip defining said opening within a groove circumscribing said filament holders.

32. The method of claim 29, wherein said opening is provided in an actuator movable between a first and second position.

33. The method of claim 32, further including the step of maintaining said filament holders in a straight row when said actuator is in said first position and urging said filament holder from within said one of said secondary openings between the filament holders within said primary opening upon movement of said actuator from said first position to said second position.

34. The method of claim 33, wherein said maintaining step comprises engaging under spring force a member within a groove circumscribing said filament holders.

35. The method of claim 34, further including the step of providing a spacer laterally movable along said member, said spacer having a opening extending underlying said pair of secondary openings of said opening upon movement of said actuator from said first position to said second position.

36. The method of claim 35, further including the step of laterally biasing said spacer on either side thereof.

37. The method of claim 35, further including the step of confining said spacer to movement between said pair of secondary openings.

38. A method of braiding elongated filaments, said method comprising the steps of providing an actuator including an opening having a primary opening and a pair of spaced apart secondary openings, positioning a plurality of filament holders within said opening, inserting at least one filament within each of said filament holders, moving said actuator repetitively between a first and second position for manipulation of said filament holders within said opening between said primary opening and said secondary openings, whereby said filament holder within said one of secondary openings is manipulated into a position between the filament holders within said primary opening while one of said filament holders within said primary opening is manipulated into a position within the other of said secondary openings.

39. The method of claim 38, further including the step of maintaining said filament holders in contiguous relationship during movement of said filament holders within said opening.

40. The method of claim 38, further including the step of retaining said filament holders within said opening by engaging a lip defining said opening within a groove circumscribing said filament holders.

41. The method of claim 38, further including the step of maintaining said filament holders in a straight row when said actuator is in said first position and urging said filament holder from within said one of said secondary openings between the filament holders within said primary opening upon movement of said actuator from said first position to said second position.

42. The method of claim 41, wherein said maintaining step comprises engaging under spring force a member within a groove circumscribing said filament holders.

43. The method of claim 42, further including the step of providing a spacer laterally movable along said member, said spacer having a opening extending underlying said pair of secondary openings of said opening upon movement of said actuator from said first position to said second position.

44. The method of claim 43, further including the step of laterally biasing said spacer on either side thereof.

45. The method of claim 43, further including the step of confining said spacer to movement between said pair of secondary openings.

46. The method of claim 38, further including the step of positioning two filament holders in said primary opening and one filament holder in one of said secondary openings.

* * * * *

UNITED STATES PATENT AND TRADEMARK OFFICE
CERTIFICATE OF CORRECTION

PATENT NO. : 5,988,181

DATED : November 23, 1999

INVENTOR(S) : GABLE, et al.

It is certified that error appears in the above-identified patent and that said Letters Patent is hereby corrected as shown below:

On the cover page, [73], "Innovations" should read --Innovation--.
Column 2, line 12, cancel the word "the".
Column 7, line 31, "extend" should read --extends--.
Column 11, line 67, "a" should read --an--.
Column 13, line 2, "a" should read --an--.
Column 14, line 3, "a" should read --an--.
Column 14, line 19, after "of" insert --said--.
Column 14, line 44, "a" should read --an--.

Signed and Sealed this

Twelfth Day of September, 2000

*Attest:*

Q. TODD DICKINSON

*Attesting Officer*

*Director of Patents and Trademarks*